United States Patent [19]

Neri

[11] Patent Number: 4,882,938

[45] Date of Patent: Nov. 28, 1989

[54] PICK-UP UNIT FOR WITHDRAWING CIGARETTE SAMPLES FROM A MASS OF CIGARETTES

[75] Inventor: Armando Neri, Naples, Italy

[73] Assignee: G.D Societa' Per Azioni, Bologna, Italy

[21] Appl. No.: 178,200

[22] Filed: Apr. 6, 1988

[30] Foreign Application Priority Data

Apr. 15, 1987 [IT] Italy ..... 3433 A/87

[51] Int. Cl.[4] ..... G01N 1/08

[52] U.S. Cl. ..... 73/863.91; 73/863.01; 198/340; 414/225; 414/797

[58] Field of Search ..... 73/863.91, 863.92, 863.01, 73/864.31; 207/537; 131/282; 198/339.1, 340, 341, 346.2; 414/222, 225, 121, 797

[56] References Cited

U.S. PATENT DOCUMENTS

| | | | |
|---|---|---|---|
| 2,121,191 | 6/1938 | Tahir | 73/864.31 X |
| 2,601,786 | 7/1952 | Best | 73/863.91 X |
| 3,492,874 | 2/1970 | Morradi | 73/863.91 |
| 3,894,438 | 7/1975 | Ginsberg | 73/863.01 |
| 4,363,235 | 12/1982 | Vulliens et al. | 73/863.91 X |
| 4,574,646 | 3/1986 | Mattei et al. | 73/863.92 |

FOREIGN PATENT DOCUMENTS

| | | | |
|---|---|---|---|
| 769232 | 8/1934 | France | 73/863.92 |

*Primary Examiner*—Tom Noland

*Attorney, Agent, or Firm*—Marshall, O'Toole, Gerstein, Murray & Bicknell

[57] ABSTRACT

A pick-up unit for withdrawing sample cigarettes from a mass of cigarettes traveling perpendicularly to the cigarette axes; each cigarette occupying random positions within the mass as the latter travels in the aforementioned direction. The unit presents a mobile head for withdrawing at least one cigarette at a time from the aforementioned mass which head presents a suction seat connected to a pneumatic suction circuit and is moved along a given route, between a given release position and a pick-up position located at a random point along the aforementioned route, by reversible actuating elements controlled by a sensor connected to the aforementioned pneumatic circuit and designed to reverse the aforementioned actuating elements in response to a sharp fall in pressure inside the aforementioned pneumatic circuit.

4 Claims, 1 Drawing Sheet

PICK-UP UNIT FOR WITHDRAWING CIGARETTE SAMPLES FROM A MASS OF CIGARETTES

BACKGROUND OF THE INVENTION

The present invention relates to a pick-up unit for withdrawing cigarette samples from a mass of cigarettes. The cigarettes coming off machinery, such as manufacturing or filter assembly machines, are known to be supplied to packing machines along conveyor belts, on which the cigarettes are arranged crosswise in relation to the traveling direction of the belts, and are stacked one on top of the other to form a layer of substantially uniform thickness in excess of the diameter of each individual cigarette. The standard practice, at present, is for one or more cigarettes to be removed manually, at regular time intervals, from the mass traveling along the conveyor belt, either for the purpose of inspection or for supply to automatic quality control equipment designed to supply data for calibrating machinery upstream from the conveyor belts.

Such manual withdrawal, however, has been found to involve a number of drawbacks, especially when the cigarettes are withdrawn in bunches. Due to the highly delicate nature of the cigarettes, in fact, manual withdrawal frequently results in damage, such as crushing, tearing of the paper, or loss of tobacco from the ends, which, during inspection or quality control, may lead to an erroneous interpretation of the quality of the cigarettes being produced, and, at times, erroneous adjustment of the manufacturing or filter assembly machines upstream from the conveyor belt.

SUMMARY OF THE INVENTION

The aim of the present invention is to provide a pick-up unit for withdrawing cigarette samples from a mass of cigarettes, and designed to overcome the aforementioned drawbacks associated with manual withdrawal.

With this aim in view, according to the present invention, there is provided a pick-up unit for withdrawing sample cigarettes from a mass of cigarettes traveling perpendicularly in relation to the cigarette axes, each said cigarette occupying random positions within the said mass as the latter travels in the said direction; characterized by the fact that it comprises a mobile head for withdrawing at least one cigarette at a time from the said mass, the said pick-up head, in turn, comprising at least a suction seat for picking up a respective said cigarette; a pneumatic suction circuit connected to the said seat; reversible actuating means connected to the said pick-up head, for moving the same along a given route between a given release position and a pick-up position located at a random point along the said route of the said pick-up head; and sensor means connected to the said pneumatic suction circuit, for reversing the said actuating means in response to a sharp fall in pressure inside the said pneumatic circuit.

BRIEF DESCRIPTION OF THE DRAWINGS

The present invention will be described, by way of a non-limiting example, with reference to the accompanying drawings, in which.

DETAILED DESCRIPTION OF THE INVENTION

Figure 1:
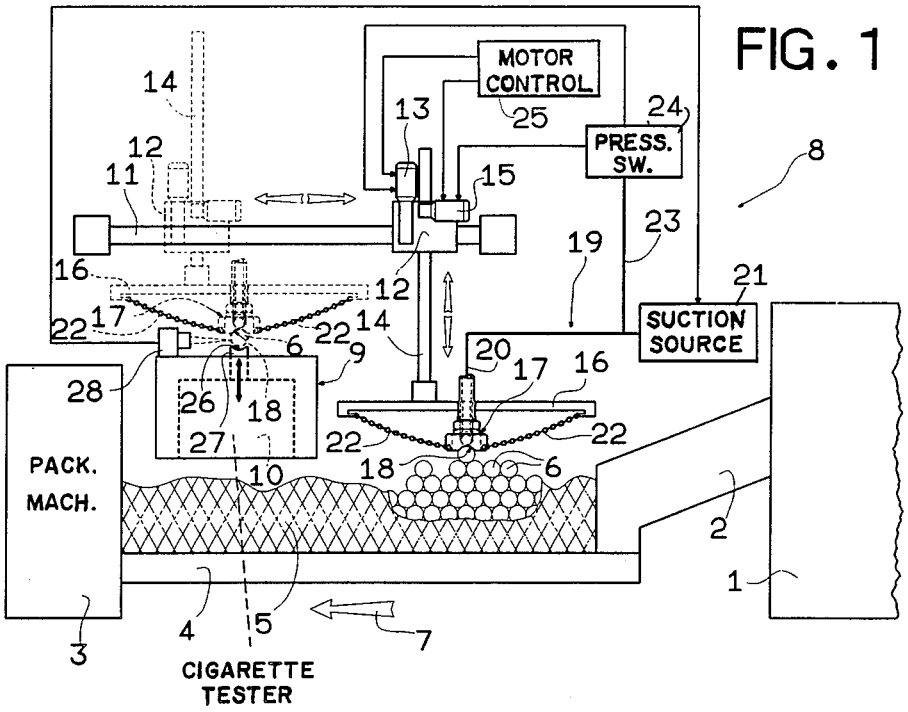
FIG. 1 shows a schematic, partial block diagram of a first embodiment of the pick-up unit according to the present invention.

Number 1 in FIG. 1 indicates a filter assembly machine, the output channel 2 of which is connected to the input of a packing machine 3 by a substantially horizontal conveyor 4 designed to feed machine 3 with a mass 5 of cigarettes 6 arranged substantially in bulk and crosswise in relation to the traveling direction of mass 5 as shown by arrow 7.

Over the said conveyor 4, there is provided a pick-up unit indicated as a whole by 8 and designed to withdraw single cigarettes 6 from mass 5 and feed the same successively into a container 9 also located over conveyor 4 and housing a control device 10 designed to determine a number of physical characteristics of the cigarettes 6 fed into the same.

The said pick-up unit 8 comprises a fixed crosspiece 11 extending substantially horizontally over conveyor 4 and supporting, in sliding manner, a slide 12 designed to travel in reciprocating manner along crosspiece 11 by virtue of a reversible actuating means consisting of a reversible motor 13. The said slide 12 supports, in sliding manner, a substantially vertical rod 14 designed to move in axially reciprocating manner in relation to slide 12, by virtue of a reversible actuating means consisting of a motor 15 on slide 12 itself. The bottom end of rod 14 is connected integral with the intermediate portion of a substantially horizontal crosspiece 16 parallel with crosspiece 11 and to the center line of which is connected a pick-up head 17.

The said head 17 extends downwards from crosspiece 16 towards conveyor 4, and presents, on its bottom end, a substantially semicircular-section groove 18 parallel with the axes of cigarettes 6 inside mass 5 on conveyor 4. The said groove 18 constitutes a suction seat for a respective cigarette 6, which is retained inside groove 18 by a pneumatic circuit 19 comprising a duct 20, which comes out at one end inside groove 18 and is connected at the other end to a suction source 21.

On opposite sides of head 17 in relation to groove 18, there are connected the ends of two flexible strips 22, each preferably formed from wire mesh and connected at the other end to a respective end of crosspiece 16.

At one point along duct 20, there is connected the end of an input duct 23 of a sensor 24, in particular, an electrial-output pressure switch designed to emit a control signal for reversing motor 15 in response to a sharp fall in pressure inside duct 20.

Motors 13 and 15 are controlled by a known type of control system 25 designed to move head 17 along a given route, between a given first position, as shown by the dotted line in FIG. 1 and wherein groove 18 is located facing a corresponding groove 26 formed on a mobile arm 27 in the raised position enabling input to control device 10, and a second random position along the said route of head 17, wherein motor 15 is reversed subsequent to the reversing signal emitted by sensor 24. In more detail, starting from the said first position, the said control system 25, whenever it is activated by a timing device (not shown) or simply by means of a manually-operated push-button (not shown), moves slide 12 from a first to a second limit position as shown respectively by the dotted and continuous lines in FIG. 1. Upon slide 12 moving into the said second limit position, motor 15 is activated in known manner, in particular by slide 12 activating limit microswitches (not shown), in such a manner as to move rod 14 downwards from a fully-raised position (not shown) into a position wherein motor 15 is reversed by sensor 24.

Container 9 is connected to a sensor device 28 which, in response to the presence of a cigarette 6 inside seat 26 in its raised position, emits a signal for de-activating suction source 21.

Operation of unit 8 will now be described commencing from when head 17, in the idle position shown by the dotted line in FIG. 1, is moved for withdrawing a cigarette 6 from mass 5 and feeding it to control device 10.

As already stated, upon receiving the said enabling signal, control system 25 activates source 24; motor 13, so as to move slide 12 along crosspiece 11 into the position shown by the continuous line in FIG. 1; and then motor 15, so as to move rod 14 downwards from the raised position shown by the dotted line to the left of FIG. 1. Such downward displacement causes strips 22 to cooperate with and, consequently, smooth out any peaks on mass 5 of cigarettes 6 traveling along conveyor 4. By virtue of the vacuum formed inside groove 18, a cigarette 6 is sucked up into contact with head 17, thus closing the mouth of duct 20 and producing a sharp fall in pressure inside the same. In response to the said fall in pressure, pressure switch 24 reverses motor 15, which moves rod 14 back into the raised position, thus carrying the said cigarette 6 upwards. Subsequent activation of motor 13 transfers the said cigarette 6 over seat 26 into which it is released by virtue of sensor 28 de-activating source 24.

Unit 8 therefore enables cigarettes 6 to be withdrawn from moving mass 5 without damaging either the sample cigarette 6 or the adjacent cigarettes 6 within the said mass 5. This is made possible by virtue of the downward movement of head 17 along the said given route being arrested and reversed as soon as respective groove or seat 18 is engaged by a cigarette 6 at any point along the said route towards the said mass 5.

Displacement of unit 8 from the release position over seat 26 may obviously be employed for replacing checked cigarettes 6 inside the said mass 5.

Figure 2:
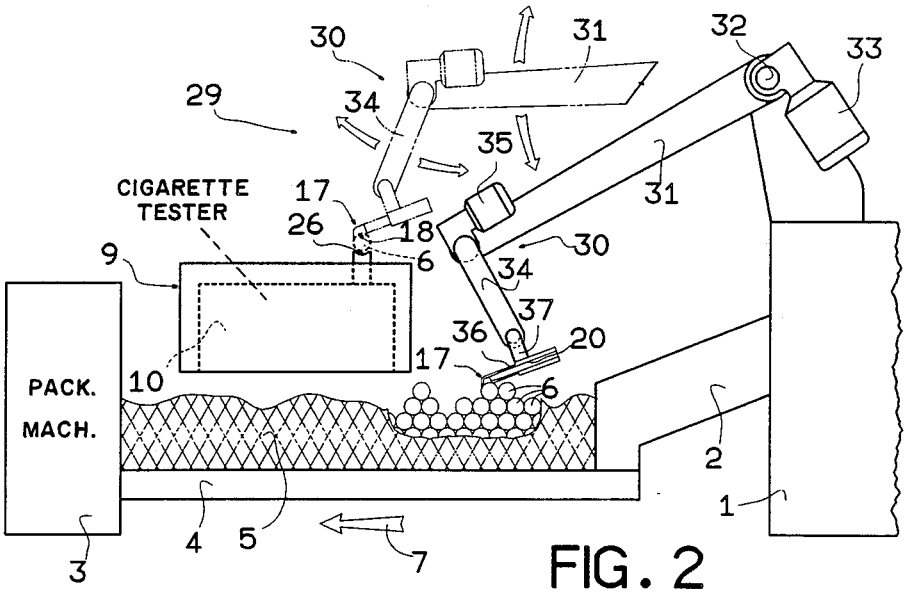
FIG. 2 shows a schematic view of a second embodiment of the pick-up unit according to the present invention.

The FIG. 2 embodiment is substantially the same as that of FIG. 1, the only difference being that it comprises a pick-up unit 29 on which displacement of head 17 along a given route extending between a release position facing seat 26, and a pick-up position located at a random point along the said route, is performed by an articulated system 30 comprising a first arm 31 designed to turn about a fixed shaft 32 by virtue of a reversible actuating means consisting of reversible motor 33, and a second arm 34 pivoting on the free end of arm 31 and designed to turn in relation to the same by virtue of a reversible actuating means consisting of a reversible motor 35.

In the case of unit 29, strips 22 of unit 8 are dispensed with, and head 17 is mounted on the end of a tubular arm 36 housing one end of duct 20 and having, at an intermediate point, a lateral appendix 37 hinged in idle manner on to the free end of arm 34.

Motors 33 and 35 are obviously controlled in the same way as motors 13 and 15.

I claim:

1. A pick-up unit for withdrawing sample cigarettes from a mass of cigarettes traveling perpendicularly in relation to the cigarette axes, each said cigarette occupying random positions within the said mass as the latter travels in the said direction; the pick-up unit comprising a mobile head (17) for withdrawing at least one cigarette (6) at a time from said mass (5), the mobile head (17), in turn, comprising at least one suction seat (18) for picking up a respective said cigarette (6); a pneumatic suction circuit (19) connected to said seat (18); reversible actuating means (13, 15 or 33, 35) connected to the mobile head (17), for moving the mobile head along a given route between a given release position and a pick-up position, which is located at a random point along the route of the mobile head (17); and sensor means (24) connected to the pneumatic suction circuit (19), for reversing the actuating means (13, 15 or 33, 35) in response to a sharp fall in pressure inside the pneumatic circuit (19).

2. A pick-up unit as claimed in claim 1, wherein the pneumatic circuit (19) comprises a suction source (21) and a duct (20) connecting the suction source (21) to suction seat (18); said sensor means (24) being connected to an intermediate point on said duct (20).

3. A pick-up unit as claimed in claim 2, wherein said sensor means (24) comprises a pressure switch connected to said duct (20) and designed to emit a signal for reversing said reversible actuating means (13, 15 or 33, 35).

4. A pick-up unit as claimed in claim 1, comprising further sensor means (28) designed to de-activate said pneumatic suction circuit (19) in response to the presence of a cigarette (6) in said suction seat (18) in said release position.

* * * * *

UNITED STATES PATENT AND TRADEMARK OFFICE

CERTIFICATE OF CORRECTION

PATENT NO. : 4,882,938

DATED : November 28, 1989

INVENTOR(S) : ARMANDO NERI

It is certified that error appears in the above-identified patent and that said Letters Patent is hereby corrected as shown below:

In the patent face sheet, in item [75], change "Naples" to -- Bologna --.

Signed and Sealed this

Twenty-fifth Day of June, 1991

*Attest:*

*Attesting Officer*

HARRY F. MANBECK, JR.

*Commissioner of Patents and Trademarks*